US008845378B2

(12) United States Patent
Lee et al.

(10) Patent No.: US 8,845,378 B2
(45) Date of Patent: Sep. 30, 2014

(54) DISPLAY APPARATUS AND METHOD OF REPAIRING THE SAME

(75) Inventors: June Woo Lee, Yongin (KR); Jae Beom Choi, Yongin (KR); Kwan Wook Jung, Yongin (KR); Guang Hai Jin, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 148 days.

(21) Appl. No.: 13/526,379

(22) Filed: Jun. 18, 2012

(65) Prior Publication Data

US 2013/0162619 A1 Jun. 27, 2013

(30) Foreign Application Priority Data

Dec. 27, 2011 (KR) ..... 10-2011-0143916

(51) Int. Cl.
*H01J 9/00* (2006.01)
*H01J 9/50* (2006.01)

(52) U.S. Cl.
USPC ..... 445/2; 345/55

(58) Field of Classification Search
USPC ..... 345/77, 82, 83, 206, 212; 257/71, 98; 358/505; 445/2
See application file for complete search history.

(56) References Cited

U.S. PATENT DOCUMENTS 7,956,830 B2 * 6/2011 Chen et al. ..... 345/82
2005/0218418 A1 * 10/2005 Cok ..... 257/98
2007/0030233 A1 * 2/2007 Chai et al. ..... 345/98
2007/0126671 A1 * 6/2007 Naoaki ..... 345/77
2008/0204384 A1 * 8/2008 Lee et al. ..... 345/83
2010/0015876 A1 * 1/2010 Kang et al. ..... 445/2
2011/0043500 A1 * 2/2011 Kwak et al. ..... 345/206
2011/0157105 A1 6/2011 Choe et al.
2011/0275270 A1 * 11/2011 Matsuoka et al. ..... 445/2
2011/0309368 A1 * 12/2011 Yamazaki et al. ..... 257/71
2012/0062545 A1 * 3/2012 Kim ..... 345/212

FOREIGN PATENT DOCUMENTS

KR 1999-0033764 A 5/1999
KR 10-2001-0103431 A 11/2001
KR 10-2008-0041015 A 5/2008
KR 10-2011-0078395 A 7/2011

* cited by examiner

*Primary Examiner* — Claire X Pappas
*Assistant Examiner* — Abdul-Samad A Adediran
(74) *Attorney, Agent, or Firm* — Knobbe Martens Olson & Bear, LLP

(57) ABSTRACT

A display apparatus and a method of repairing a display apparatus are disclosed. According to one aspect, the display includes a plurality of unit pixels each including a plurality of sub pixels, scan lines branching off a scan wire in a first direction for each of the plurality of unit pixels and connecting the plurality of sub pixels emitting the same color as that of a neighboring unit pixel, data lines extending in a second direction orthogonal to the first direction and connected to the plurality of sub pixels, a first power supply line extending in the second direction and connected to the plurality of sub pixels, and second power supply lines extending in the first direction and connected to the first power supply line.

12 Claims, 6 Drawing Sheets

DISPLAY APPARATUS AND METHOD OF REPAIRING THE SAME

CROSS-REFERENCE TO RELATED APPLICATIONS

This application claims the benefit of Korean Patent Application No. 10-2011-0143916, filed on Dec. 27, 2011, in the Korean Intellectual Property Office, the disclosure of which is incorporated herein in its entirety by reference.

BACKGROUND

1. Field

The technological field relates to an organic light-emitting diode (OLED) display apparatus that prevents a voltage drop and includes repairable power supply lines.

2. Description of the Related Technology

Organic light-emitting diode (OLED) displays include a thin film transistor (TFT), and an organic electroluminescent device (herein, organic EL device) driven by the TFT and to generate an image. For example, if a current is supplied to the organic EL device through the TFT, the organic EL device emits light and to generate an image.

Further, OLED displays may include a number of layers including various wires connected to the TFT. Of these wires, a power voltage supply line (generally referred to as an ELVDD wire) has a very relatively greater width than other wires.

The width of the ELVDD wire increases an area where the wire and other wires disposed on other layers overlap, thereby increasing the possibility of a short between different wires in the display. Thus, a method of repairing a defective pixel due to a short between power voltage supply wires may be desirable.

SUMMARY OF CERTAIN INVENTIVE ASPECTS

A display apparatus and a method of repairing the display apparatus are described.

According to one aspect, a display apparatus is disclosed. The display apparatus includes a plurality of unit pixels each including a plurality of sub pixels, scan lines branching off a scan wire in a first direction for each of the unit pixels, the scan lines being connected to the sub pixels emitting the same color as that of a neighboring unit pixel, data lines extending in a second direction orthogonal to the first direction, the data lines being connected to the plurality of sub pixels, a first power supply line extending in the second direction, the first power supply line being connected to the plurality of sub pixels, and second power supply lines extending in the first direction, the second power supply lines being connected to the first power supply line.

According to another aspect, a method of repairing a display apparatus is disclosed. The display apparatus including a plurality of unit pixels each including a plurality of sub pixels, scan lines branching off a scan wire in a first direction for each of the plurality of unit pixels and connecting the sub pixels emitting the same color as that of a neighboring unit pixel, data lines extending in a second direction orthogonal to the first direction and connected to the plurality of sub pixels, a first power supply line extending in the second direction and connected to the plurality of sub pixels, and second power supply lines extending in the first direction and connected to the first power supply line. The method includes measuring a voltage difference at both ends of a region in which the scan lines branch off in the first direction and a voltage difference at both ends of the first power supply line, detecting a location of a defective unit pixel that is shorted between the scan lines and the first power supply line based on the measured voltage difference, and disconnecting the first power supply line from each sub pixel of the detected defective unit pixel.

BRIEF DESCRIPTION OF THE DRAWINGS

Some embodiments will be described more fully hereinafter with reference to the accompanying drawings, in which some are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. In the drawings, the size and relative sizes of layers and regions may be exaggerated for clarity.

DETAILED DESCRIPTION OF CERTAIN INVENTIVE EMBODIMENTS

Hereinafter, some embodiments will be described more fully with reference to the accompanying drawings. As used herein, expressions such as "at least one of," when preceding a list of elements, modify the entire list of elements.

Figure 1:
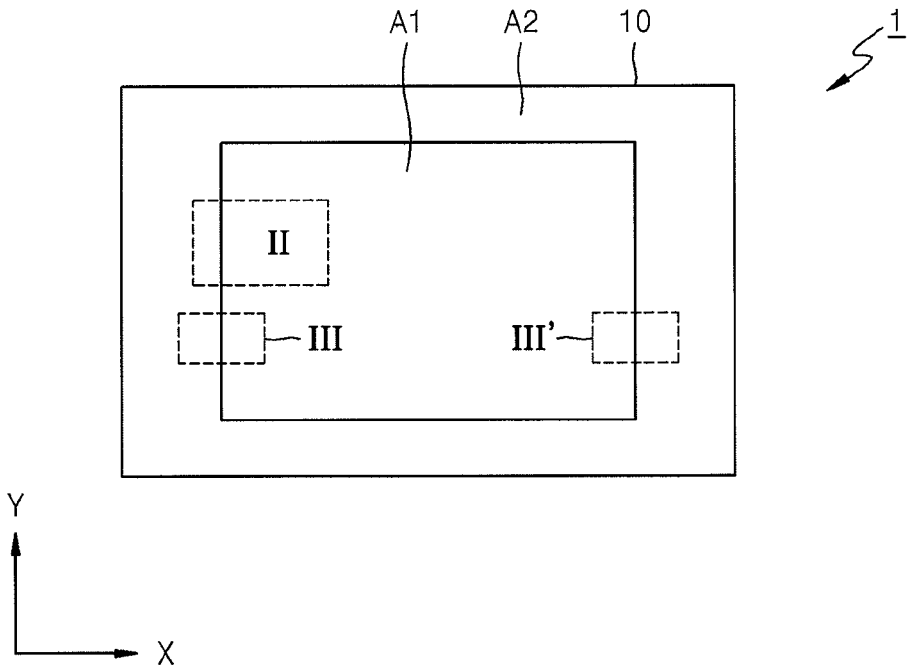
FIG. 1 is a plan view of an organic light-emitting diode (OLED) display according to some embodiments.
Figure 2:
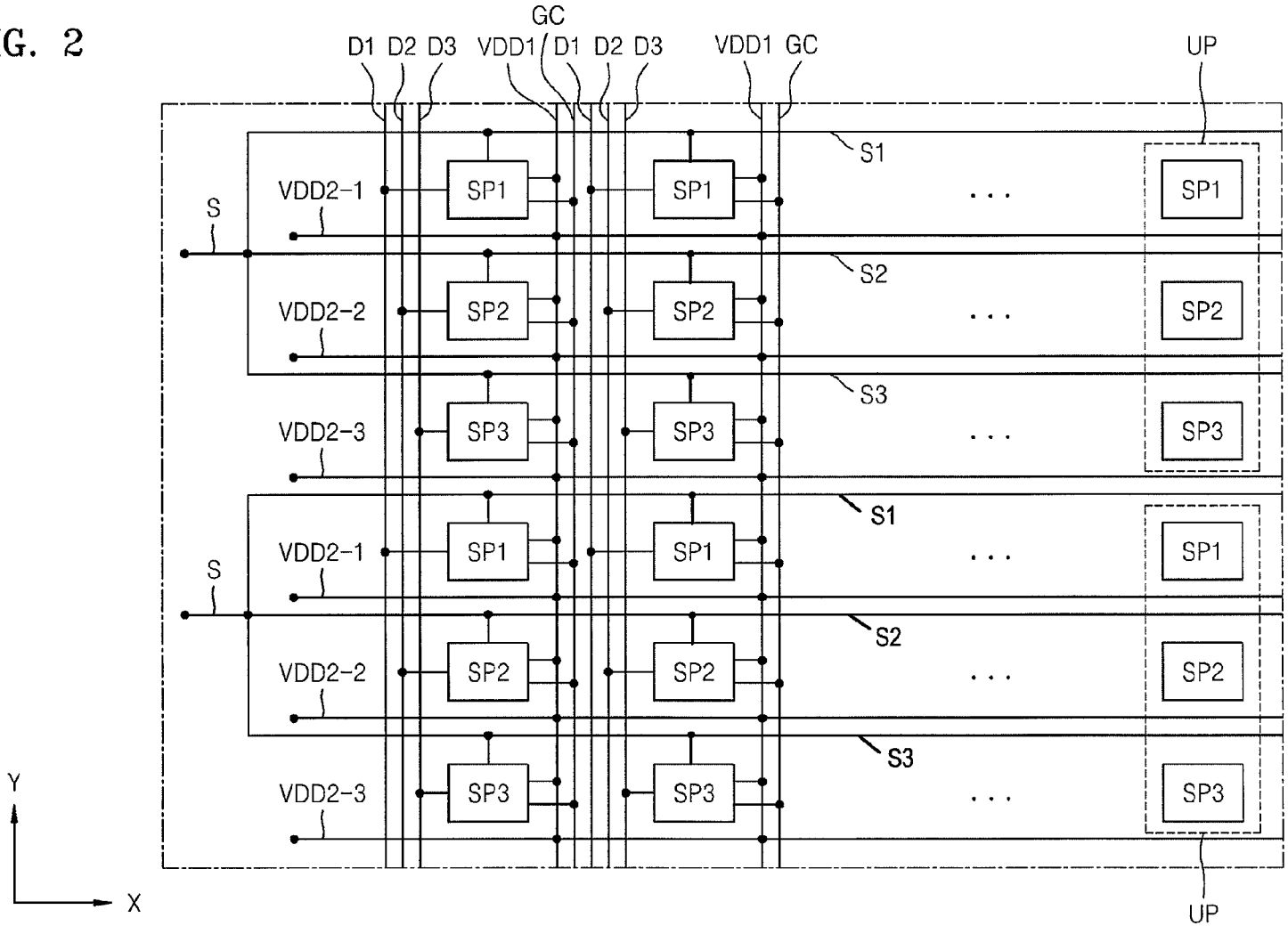
FIG. 2 is a schematic cross-sectional view of wires in a region II of FIG. 1.

FIG. 1 is a plan view of an OLED display 1 according to an embodiment of the present invention. FIG. 2 is a schematic cross-sectional view of wires in a region II of FIG. 1.

As shown in FIG. 1, the OLED display 1 includes a display area A1 and a non-display area A2 on a substrate 10.

As shown in FIG. 2, the display area A1 includes a plurality of unit pixels UP in which an image is formed.

Each unit pixel UP includes a plurality of sub pixels SP1, SP2, and SP3 that emit different colors. For example, each unit pixel UP may include a sub pixel that emits red, a sub pixel that emits green, and a sub pixel that emits blue. Although the three sub pixels SP1, SP2, and SP3 form the unit pixel UP in some examples, the OLED display is not limited thereto. For example, light emitted from a plurality of sub pixels may be mixed to emit white or a specific color, and the number of sub pixels of a unit pixel may be greater than or less than three.

In some embodiments, the sub pixels SP1 that emit the same color are disposed in a first direction X of the display area A1. The sub pixels SP1, SP2, and SP3 that emit different colors may be disposed in a second direction Y orthogonal to the first direction X as shown in FIG. 1 such that a pattern of same color sub pixel rows repeats every three rows of sub pixels. As discussed above, the sub pixels SP1, SP2, and SP3 may form one unit pixel UP.

First through third scan lines S1, S2, and S3 that branch off one scan wire S and extend in the first direction X are arranged in each unit pixel UP. The first scan lines S1 are connected to the sub pixels SP1, respectively, that emit a first color of neighboring unit pixels UP. The second scan lines S2 are connected to the sub pixels SP2, respectively, that emit a second color of neighboring unit pixels UP. The third scan lines S3 are connected to the sub pixels SP3, respectively, that emit a third color of neighboring unit pixels UP. Although the sub pixels SP1, SP2, and SP3 of one unit pixel UP are respectively connected to the first through third scan lines S1, S2, and S3, since each group of first through third scan lines S1, S2, and S3 branch off one scan wire S, the same scan signal is input to each sub pixel SP1, SP2, and SP3 of each unit pixel UP.

First through third data lines D1, D2, and D3 that are independently and respectively connected to the sub pixels SP1, SP2, and SP3 that emit different colors and extend in the second direction Y are disposed in each unit pixel UP. That is, the first data line D1 is connected to the sub pixel SP1 that emits a first color, the second data line D2 is connected to the sub pixel SP2 that emits a second color, and the third data line D3 is connected to the sub pixel SP3 that emits a third color. Thus, different data signals may be input to the sub pixels SP1, SP2, and SP3 of each unit pixel UP.

In some embodiments, lengths of the first through third data lines D1, D2, and D3 are less that those of the first through third scan lines S1, S2, and S3. If the lengths of the first through third data lines D1, D2, and D3 increase, intensities of data signals input to the sub pixels SP1, SP2, and SP3 may be reduced due to wire resistances corresponding to the lengths of the data lines. An OLED display is generally more sensitive to a data signal than a scan signal. Thus, according to some embodiments, by reducing the length of the data lines, non-uniformity of data signals input to the OLED display 1 may be prevented.

A first power supply line VDD1 for supplying power is connected to the sub pixels SP1, SP2, and SP3 of the display area A1 in the second direction Y. Since the first power supply line VDD1 is disposed in the second direction Y as shown in FIG. 2, a length of the first power supply line VDD1 is shorter than those of the first through third scan lines S1, S2, and S3. A voltage drop may occur in the first power supply line VDD1 with respect to the length of the power line VDD1 due to resistance of the wire forming the power line VDD1.

To reduce the effect of the voltage drop of the first power supply line VDD1, additional power supply lines may be connected to the sub pixels SP1, SP2, and SP3. According to some embodiments, each of the sub pixels SP1, SP2, and SP3 included in one unit pixel UP includes second power supply lines VDD2-1, VDD2-2, and VDD2-3 that are connected to the first power supply line VDD1 in the first direction X.

The second power supply lines VDD2-1, VDD2-2, and VDD2-3 may be disposed between each of the first through third scan lines S1, S2, and S3 respectively connected to the sub pixels SP1, SP2, and SP3 of one unit pixel UP. According to some embodiments, the second power supply lines VDD2-1, VDD2-2, and VDD2-3 are respectively connected to all the sub pixels SP1, SP2, and SP3 of one unit pixel UP. However, the embodiments are not limited thereto. At least two of the second power supply lines VDD2-1, VDD2-2, and VDD2-3 may also be disposed between the first through third scan lines S1, S2, and S3 respectively connected to the sub pixels SP1, SP2, and SP3 of one unit pixel UP, as will be described below in greater detail with reference to FIG. 8.

The first power supply line VDD1 is generally wider than the first through third scan lines S1, S2, and S3 and/or the first through third data lines D1, D2, and D3. As a result, the possibility of a short between wires increases due to an increase of an area in which the wire corresponding to first power supply line VDD1 and a wire disposed on another layer overlap. According to some embodiments, since the first power supply line VDD1 overlaps with and crosses the first through third scan lines S1, S2, and S3, the first power supply line VDD1 can be repaired when a short occurs between the first power supply line VDD1 and the first through third scan lines S1, S2, and S3.

If the shorted first power supply line VDD1 is disconnected and removed from a normal wire at a point where the first power supply line VDD1 and the first through third scan lines S1, S2, and S3 cross each other, the second power supply lines VDD2-1, VDD2-2, and VDD2-3 may be used as bypass lines for repairing the first power supply line VDD1, as will be described below.

The OLED display 1 according to some embodiments may further include a compensation control signal line GC for compensating for a threshold voltage of a third TFT TR3 as will be described in greater detail below with reference to FIG. 9. The compensation control signal line GC may be connected to the sub pixels SP1, SP2, and SP3 in the second direction Y.

FIG. 2 merely illustrates wires for explaining complex relations there between according to the present embodiment. In FIG. 2, crossing wires having dots (*) are electrically connected, and crossing wires without dots (*) are not electrically connected. For example, the first power supply line VDD1 is electrically connected to the second power supply lines VDD2-1, VDD2-2, and VDD2-3 of the sub pixels SP1, SP2, and SP3.

Figure 3:
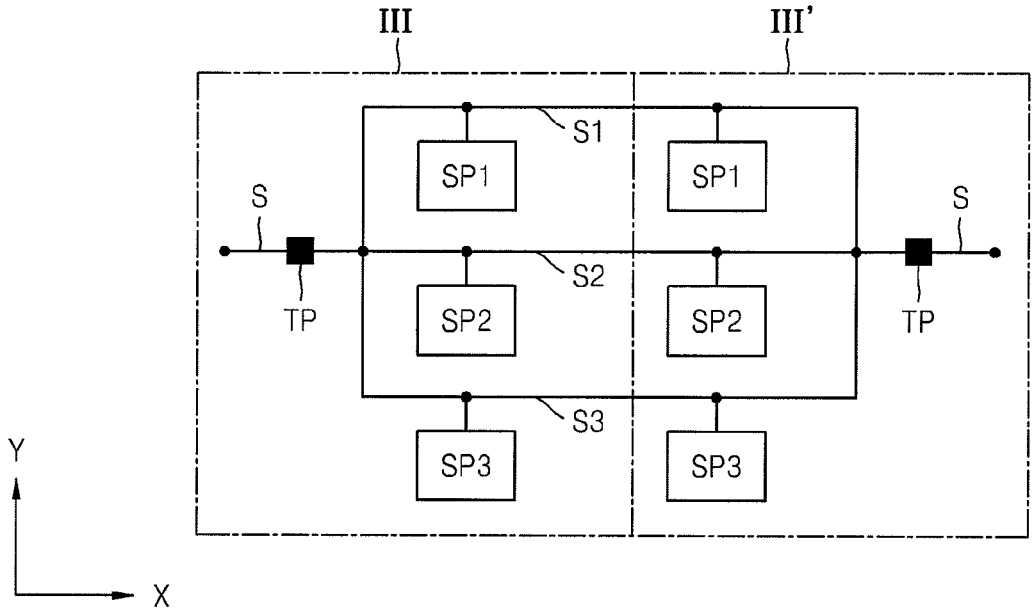
FIG. 3 is a schematic cross-sectional view a scan line in regions III and III' of FIG. 1.

FIG. 3 is a schematic cross-sectional view of the scan wire S in regions III and III' of FIG. 1.

As shown in FIG. 3, the scan wire S before branching off into the sub pixels SP1, SP2, and SP3 is disposed in a boundary of the display area A1. Test pads TP may be further disposed at both ends of the scan wire S in the first direction X before branching off into the sub pixels SP1, SP2, and SP3.

As described above with reference to FIG. 2, a short may occur between the first power supply line VDD1 and the first through third scan lines S1, S2, and S3 that overlap and cross each other. A defective location at which the short occurs needs to be detected in order to repair the short.

According to some embodiments, the test pads TP may be used to measure a voltage difference at both ends of an area in which the scan wire S branches off in the first direction X, and detect whether the short occurs in one of the plurality of scan lines S (see FIG. 2) that do not branch off.

Defective locations are detected in the first direction X and then in the second direction Y. The defective location in the second direction Y may be detected using the voltage difference at both ends of the first power supply line VDD1 extending in the second direction Y.

As described above, if the defective locations are detected in the first direction X and the second direction Y, a location of a defective unit pixel may be determined. According to some embodiments, since the scan wire S branches off with respect to the sub pixels SP1, SP2, and SP3 of each unit pixel UP, a minimum unit used to determine a defective location is a unit pixel other than a sub pixel.

If the location of the defective unit pixel is determined, the first power supply line VDD1 that is shorted from the scan wire S in each of the sub pixels SP1, SP2, and SP3 of a defective unit pixel is disconnected in order to repair the defective unit pixel. In this regard, since a defective unit pixel is not determined, the first power supply line VDD1 connected to all sub pixels of the defective unit pixel is disconnected.

Figure 4:
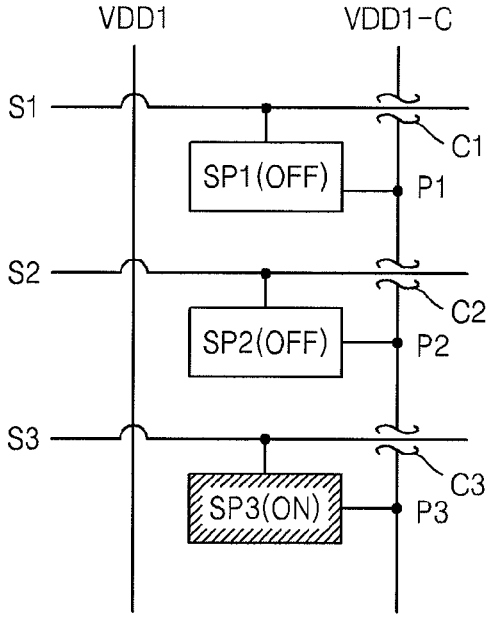
FIG. 4 is a diagram of a wire configuration according to a first comparative example.

FIG. 4 is a diagram of a wire configuration according to a first comparative example. In FIG. 4, the wire configuration in which the second power supply line VDD2 is not formed in each of the sub pixels SP1, SP2, and SP3 shows whether each of the sub pixels SP1, SP2, and SP3 of a defective unit pixel is turned on (defective) when the first power supply line VDD1 is disconnected for repair.

The defective unit pixel includes the three sub pixels SP1, SP2, and SP3. The first power supply line VDD1 is disconnected at areas C1, C2, and C3 in which the first power supply line VDD1 and the first through third scan lines S1, S2, and S3 cross each other.

The first power supply line VDD1 is not electrically connected to a contact point P1 between the first scan line S1 and a first power supply line VDD1-C that is disconnected from the sub pixel SP1, and thus the sub pixel SP1 does not emit light. The first power supply line VDD1 is not electrically connected to a contact point P2 between the second scan line S2 and the first power supply line VDD1-C that is disconnected from the sub pixel SP2, and thus the sub pixel SP2 does not emit light. However, the first power supply line VDD1 that is connected to a unit pixel (not shown) neighboring below the sub pixel SP3 is electrically connected to a contact point P3 between the third scan line S3 and the first power supply line VDD1-C that is disconnected from the third sub pixel SP3, and thus the sub pixel SP3 emits light.

As a result, at least two sub pixels SP1 and SP2 do not emit light in the first comparison example, which causes an error in the display image.

Figure 5:
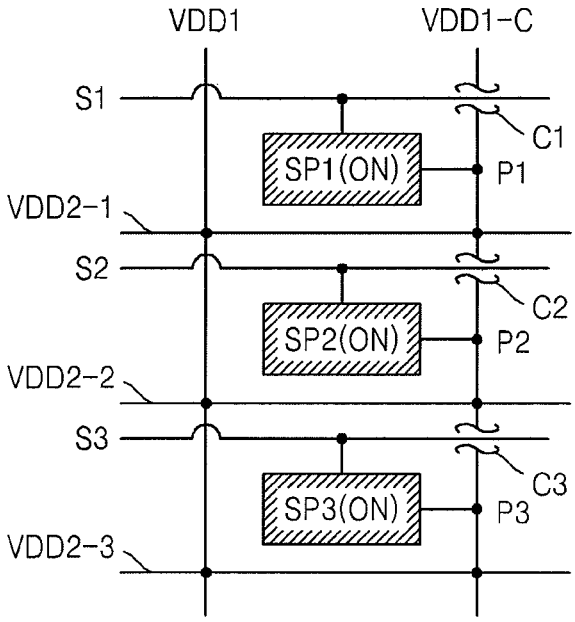
FIG. 5 is a diagram of a wire configuration according to some embodiments.

FIG. 5 is a diagram of a wire configuration according to some embodiments. The second power supply lines VDD2-1, VDD2-2, and VDD2-3 are formed in all the sub pixels SP1, SP2, and SP3. The first power supply line VDD1 is disconnected at points C1, C2, and C3 in areas of the sub pixels SP1, SP2, and SP3 in which the first power supply line VDD1 and the first through third scan lines S1, S2, and S3 cross each other.

As shown in FIG. 5, the second power supply line VDD2-1 is electrically connected to the contact point P1 between the first scan line S1 and the first power supply line VDD1-C that is disconnected from the sub pixel SP1, and is also electrically connected to the first power supply line VDD1, and thus the sub pixel SP1 is normally turned on. The second power supply line VDD2-2 is electrically connected to the contact point P2 between the second scan line S2 and the first power supply line VDD1-C that is disconnected from the sub pixel SP2, and thus the sub pixel SP2 is normally turned on. The second power supply line VDD2-3 is electrically connected to the contact point P3 between the third scan line S3 and the first power supply line VDD1-C that is disconnected from the sub pixel SP3, and thus the sub pixel SP3 is normally turned on.

Therefore, according to some embodiments, the second power supply lines VDD2-1, VDD2-2, and VDD2-3 are used as bypasses to repair the first power supply line VDD1, and all the sub pixels SP1, SP2, and SP3 of a defective unit pixel normally turn on, and thus the defective unit pixel is repaired.

Figure 6:
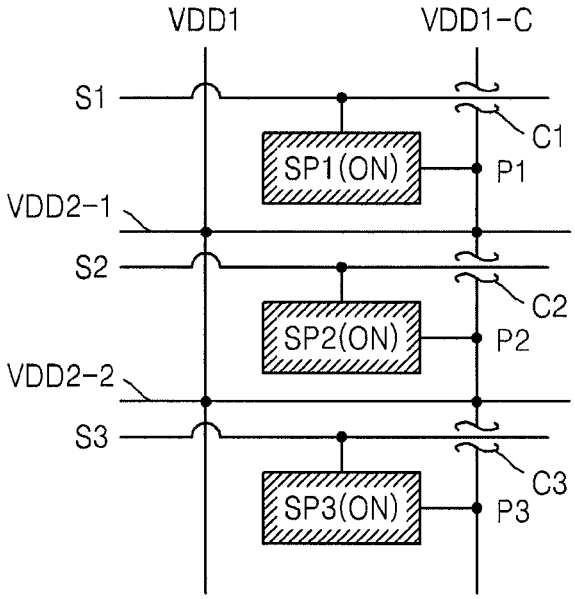
FIG. 6 is a diagram of a wire configuration according to some embodiments.

FIG. 6 is a diagram of a wire configuration according to a second embodiment of the present invention. The second power supply lines VDD2-1 and VDD2-2 are formed in the sub pixel SP1 and the sub pixel SP2. The first power supply line VDD1 is disconnected C1, C2, and C3 in areas of the sub pixels SP1, SP2, and SP3 in which the first power supply line VDD1 and the first through third scan lines S1, S2, and S3 cross each other.

As shown in FIG. 6, the second power supply line VDD2-1 is electrically connected to the contact point P1 between the first scan line S1 and the first power supply line VDD1-C that is disconnected from the sub pixel SP1, and is also electrically connected to the first power supply line VDD1, and thus the sub pixel SP1 is normally turned on. The second power supply line VDD2-2 is electrically connected to the contact point P2 between the second scan line S2 and the first power supply line VDD1-C that is disconnected from the sub pixel SP2, and thus the sub pixel SP2 is normally turned on. However, the second power supply line VDD2-3 is not electrically connected to the contact point P3 between the third scan line S3 and the first power supply line VDD1-C that is disconnected from the sub pixel SP3, whereas the first power supply line VDD1-C that is connected to a unit pixel (not shown) neighboring below the sub pixel SP3 is electrically connected to the contact point P3, and thus the sub pixel SP3 is normally turned on.

Therefore, According to some embodiments, the second power supply lines VDD2-1 and VDD2-2 are used as bypasses to repair the first power supply line VDD1, and all the sub pixels SP1, SP2, and SP3 of a defective unit pixel are normally turned on, and thus the defective unit pixel may be repaired.

Figure 7:
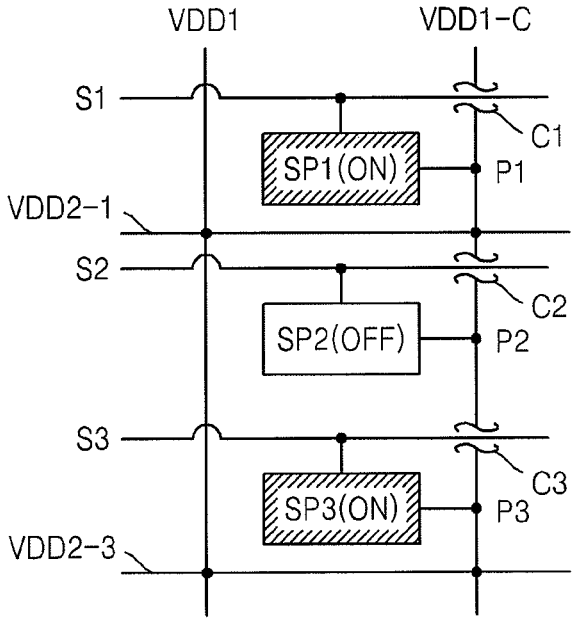
FIG. 7 is a diagram of a wire configuration according to a second comparative example.

FIG. 7 is a diagram of a wire configuration according to a second comparative example. The second power supply lines VDD2-1 and VDD2-3 are formed in the sub pixel SP1 and the sub pixel SP3. The first power supply line VDD1 is disconnected at points C1, C2, and C3 in areas of the sub pixels SP1, SP2, and SP3 in which the first power supply line VDD1 and the first through third scan lines S1, S2, and S3 cross each other.

As shown in FIG. 7, the second power supply line VDD2-1 is electrically connected to the contact point P1 between the first scan line S1 and the first power supply line VDD1-C that is disconnected from the sub pixel SP1, and is also electrically connected to the first power supply line VDD1, and thus the sub pixel SP1 is normally turned on. However, the first power supply line VDD1 is not electrically connected to the contact point P2 between the second scan line S2 and the first power supply line VDD1-C that is disconnected from the sub pixel SP2, and thus the sub pixel SP2 does not emit light. The second power supply line VDD2-3 is electrically connected to the contact point P3 between the third scan line S3 and the first power supply line VDD1-C that is disconnected from the sub pixel SP3, and thus the sub pixel SP3 may be normally turned on. As a result, at least one sub pixel SP2 does not emit light in the second comparative example, which causes an error in the displayed image.

Figure 8:
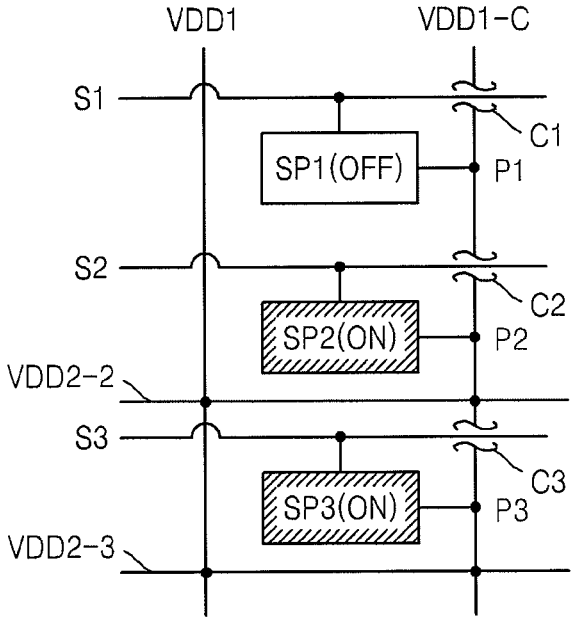
FIG. 8 is a diagram of a wire configuration according to a third comparative example.

FIG. 8 is a diagram of a wire configuration according to a third comparative example. The second power supply lines VDD2-2 and VDD2-3 are formed in the sub pixel SP2 and the sub pixel SP3. The first power supply line VDD1 is disconnected at points C1, C2, and C3 in areas of the sub pixels SP1, SP2, and SP3 in which the first power supply line VDD1 and the first through third scan lines S1, S2, and S3 cross each other.

As shown in FIG. 8, the first power supply line VDD1 is not electrically connected to the contact point P1 between the first scan line S1 and the first power supply line VDD1-C that is disconnected from the sub pixel SP1, and thus the sub pixel SP1 does not emit light. However, the second power supply line VDD2-2 is electrically connected to the contact point P2 between the second scan line S2 and the first power supply line VDD1-C that is disconnected from the sub pixel SP2, and is also electrically connected to the first power supply line VDD1, and thus the sub pixel SP2 is normally turned on. The second power supply line VDD2-3 is electrically connected to the contact point P3 between the third scan line S3 and the first power supply line VDD1-C that is disconnected from the sub pixel SP3, and thus the sub pixel SP3 may be normally turned on. As a result, at least one sub pixel SP1 does not emit light in the third comparative example, which causes an error in the displayed image.

In the embodiments and the comparative examples described with reference to FIGS. 5 through 8, when the second power supply lines VDD2-1, VDD2-2, and VDD2-3 are formed between each of the first through third scan lines S1, S2, and S3 connected to the sub pixels SP1, SP2, and SP3 in a unit pixel, respectively, a defective pixel may be repaired.

For example, in the first embodiment of FIG. 5, the second power supply lines VDD2-1, VDD2-2, and VDD2-3 are formed between each of the first through third scan lines S1, S2, and S3 connected to the sub pixels SP1, SP2, and SP3 in a unit pixel, respectively, and in the second embodiment of FIG. 6, the second power supply lines VDD2-1 and VDD2-2 are formed between each of the first through third scan lines S1, S2, and S3 connected to the sub pixels SP1, SP2, and SP3 in a unit pixel, respectively (VDD2-1 and VDD2-2 between S1 and S2 and between S2 and S3).

In the second comparative example of FIG. 7, the second power supply lines VDD2-1 and VDD2-3 are not formed between each of the first through third scan lines S1, S2, and S3 connected to the sub pixels SP1, SP2, and SP3 in a unit pixel, respectively (no second power supply line between S2 and S3), and in the third comparative example of FIG. 8, the second power supply lines VDD2-2 and VDD2-3 are not formed between each of the first through third scan lines S1, S2, and S3 connected to the sub pixels SP1, SP2, and SP3 in a unit pixel, respectively (no second power supply line between S1 and S2).

Figure 9:
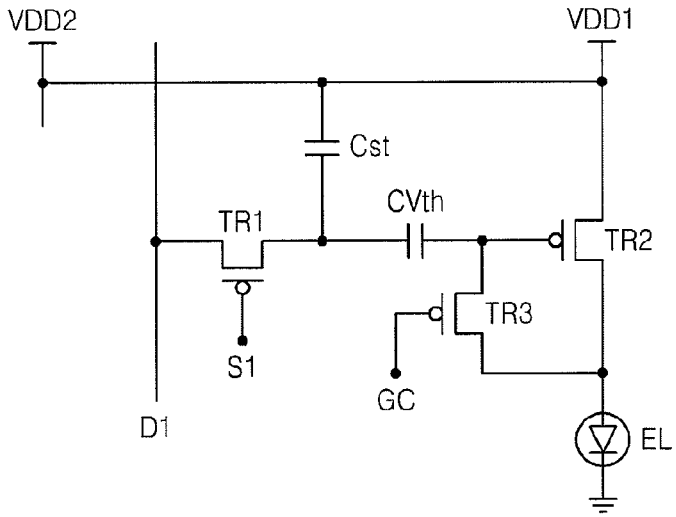
FIG. 9 is a circuit diagram of a wire configuration of a sub pixel of the OLED display according some embodiments.

FIG. 9 is a circuit diagram of a wire configuration of a sub pixel of the OLED display 1, according to some embodiments.

As shown in FIG. 9, the sub pixel includes a first TFT TR1 that is a switching TFT, a second TFT TR2 that is a driving TFT, the third TFT TR3 that is a compensation signal TFT, capacitors Cst and Cvth that are storage elements, and organic EL device driven by the first through third TFTs TR1, TR2, and TR3. The number of first through third TFTs TR1, TR2, and TR3 and capacitors Cst and Cvth is not limited to that shown in FIG. 9, and one sub pixel may include more TFTs and capacitors.

FIG. 9 illustrates the sub pixel SP 1 that emits a first color among the sub pixels SP1, SP2, and SP3 of FIG. 2. The first TFT TR1 is switched by a scan signal that is applied from the first scan line S1 and the first TFT TR1 transfers a data signal that is applied from the first data line D1 to the capacitors Cst and Cvth and the second TFT TR2. The second TFT TR2 determines an amount of current input into the organic EL device (EL as shown in FIG. 9) through the first power supply line VDD1 and the second power supply line VDD2 using the data signal transferred by the first TFT TR2 and the second TFT TR2 supplies the current to the organic EL device EL. The third TFT TR3 is connected to a compensation control signal line GC and compensates for a threshold voltage According to some embodiments, since the second power supply line VDD2 is electrically connected to the first power supply line VDD1, although the first power supply line VDD1 is short-circuited, the second power supply line VDD2 may function as a bypass line to drive the organic EL device EL.

Figure 10:
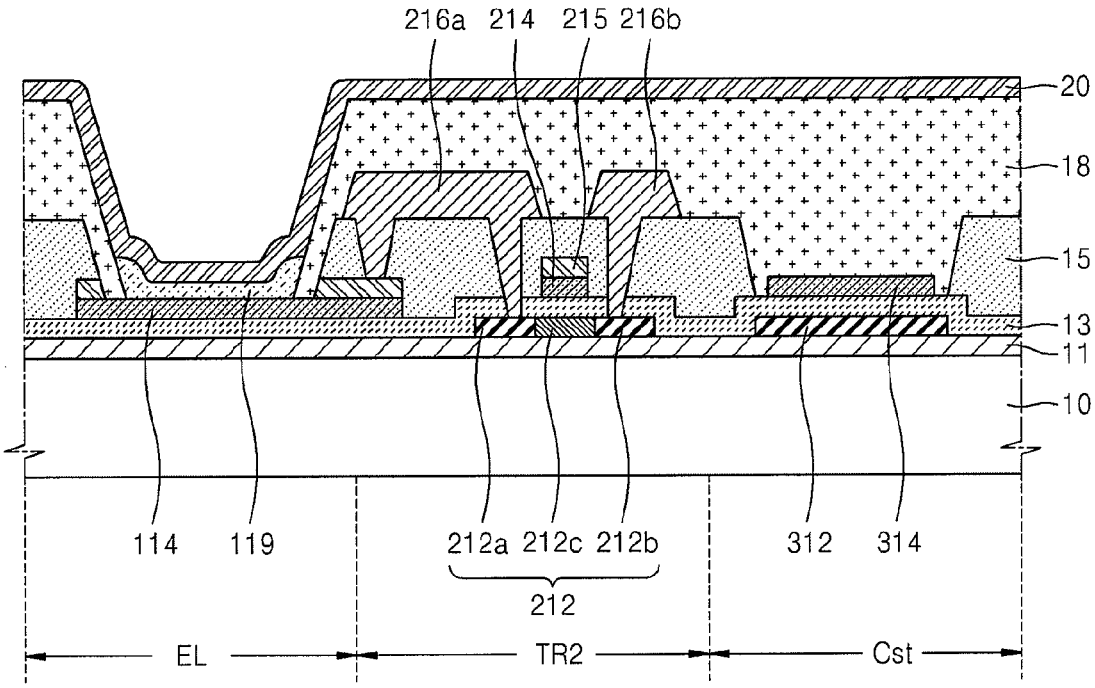
FIG. 10 is a schematic cross-sectional view of some elements of a sub pixel of the OLED display, according to some embodiments.

FIG. 10 is a schematic cross-sectional view of some elements of a sub pixel of the OLED display 1, according to some embodiments.

As shown in FIG. 10, the second TFT TR2 (which is configured as a driving TFT), the storage capacitor Cst, and the organic EL device (EL) are disposed on the substrate 10. As described above, the sub pixel further includes the first TFT TR1, the third TFT TR3, the compensation capacitor Cvth, and a plurality of wires. Some elements of the configuration of the sub pixel are briefly described with reference to FIG. 10.

The substrate 10 may be formed of a transparent material such as glass having a transparent insulating material, such as $SiO_2$, or the like, as a main component. However, the substrate 10 is not limited thereto and may be formed of a transparent plastic material, or the like.

A buffer layer 11 may be formed on the substrate 10. The buffer layer 11 provides a planar surface to a top portion of the substrate 10 and prevents moisture and impurities from penetrating into the substrate 10.

An active layer 212 of the second TFT TR2 is partially formed on the buffer layer 11. The active layer 212 may be formed of an inorganic semiconductor such as amorphous silicon or polysilicon. The active layer 212 may also be formed of various materials such as an organic semiconductor or oxide semiconductor. The active layer 212 includes a source region 212*b*, a drain region 212*a*, and a channel region 212*c*.

A gate electrode first layer 214 and a gate electrode second layer 215, including transparent conductive materials, are sequentially disposed on the active layer 212 corresponding to the channel region 212*c* of the active layer 212, and a first insulation layer 13, configured as a gate insulation film, is disposed between the active layer 212 and the gate electrode first and second layers 214 and 215.

A source electrode 216*b* and a drain electrode 216*a* respectively connected to the source region 212*b* and the drain region 212*a* of the active layer 212 are disposed on the gate electrode second layer 215, and a second insulation layer 15, configured as an interlayer insulation film, is disposed between the source electrode 216*b* and the drain electrode 216*a*.

A third insulation layer 18 is disposed on the second insulation layer 15 to cover the source electrode 216*b* and the drain electrode 216*a*. The third insulation layer 18 may be an organic insulation film.

A pixel electrode first layer 114, which may be formed of the same transparent conductive material as the gate electrode first layer 214, is partially formed on the buffer layer 11 and the first insulation layer 13. The transparent conductive material may include at least one material selected from the group consisting of indium tin oxide (ITO), indium zinc oxide (IZO), zinc oxide (ZnO), indium oxide ($In_2O_3$), indium gallium oxide (IGO), and aluminum zinc oxide (AZO).

An emissive layer 119 is partially formed on the pixel electrode first layer 114. Light emitted from the emissive layer 119 is emitted toward the substrate 10 through the pixel electrode first layer 114 formed of the transparent conductive material.

The emissive layer 119 may be formed of low molecular weight organic materials or polymer organic materials. If the emissive layer 119 is formed of low molecular weight organic materials, a hole transport layer (HTL), a hole injection layer (HIL), an electron transport layer (ETL), and an electron injection layer (EIL) may be stacked with respect to the emissive layer 119. Other various layers may be stacked according to necessity. In this regard, available organic materials include copper phthalocyanine (CuPc), N,N'-Di(naphthalene-1-yl)-N,N'-diphenyl-benzidine (NPB), tris-8-hydroxyquinoline aluminum (Alq3), etc.

If the emissive layer 119 is formed of polymer organic materials, the emissive layer 119 may include a HTL. The HTL may include a poly-(2,4)-ethylene-dihydroxy thiophene (PEDOT) or polyaniline (PANI) material. In some embodiments, available organic materials include polymer organic materials such as polyphenylene vinylene (PPV) and polyfluorene.

An opposing electrode 20 is stacked on the emissive layer 119 as a common electrode. In the OLED display 1 shown in FIG. 10, the pixel electrode first layer 114 is used as an anode, and the opposing electrode 20 is used as a cathode. The polarities of the electrodes may also be switched.

The opposing electrode 20 may be a reflective electrode including a reflective material. For example, the opposing electrode 20 may include at least one material selected from the group consisting of Al, Mg, Li, Ca, LiF/Ca, and LiF/Al.

Since the opposing electrode 20 serves as the reflective electrode, light emitted from the emissive layer 119 is reflected from the opposing electrode 20, transmits through the pixel electrode first layer 114 formed of the transparent conductive material, and is emitted toward the substrate 10.

Since the OLED display 1 shown in FIG. 10 is a bottom emission type display apparatus in which an image is formed in a direction towards the substrate 10, the pixel electrode first layer 114 may not overlap with the first through third scan lines S1, S2, and S3, the first through third data lines D1, D2, and D3, the first power supply line VDD1, and the second power supply lines VDD2-1, VDD2-2, and VDD2-3 (see FIG. 2).

A lower electrode 312 of the capacitor Cst, formed of the same material as the active layer 212 of the second TFT TR2, and an upper electrode 314, including a transparent conductive material that is the same material as the pixel electrode first layer 114, are disposed on the substrate 10 and the buffer layer 11. The first insulation layer 13 is disposed between the lower electrode 312 and the upper electrode 314.

The first insulation layer 13 is disposed on a top portion of the lower electrode 312 but is not disposed in a boundary of the upper electrode 314. The second insulation layer 15 is disposed on a top portion of the first insulation layer 13 and entirely exposes the upper electrode 314 so that the upper electrode 314 entirely contacts the third insulation layer 18.

Although not shown, a sealing member may be disposed on a top portion of the opposing electrode 20 in such a way that the sealing member faces one surface of the substrate 10. The sealing member may be formed to protect the emissive layer 119 from external moisture or oxygen, and may be formed of glass or plastic, or may have a structure in which organic materials and inorganic materials overlap with each other.

According to some embodiments described above, sub pixels of each unit pixel include scan lines that branch off one wire, data lines independently connected to the sub pixels, a first power supply line vertically disposed in the scan lines, and second power supply lines vertically connected to the first power supply line, thereby preventing voltage drops of power supply lines.

Furthermore, according to some embodiments, the second power supply lines are used as bypasses to repair the first power supply line, thereby repairing a defective unit pixel.

According to some embodiments, a display apparatus and a method of repairing the display apparatus provide the following effects.

First, sub pixels of each unit pixel include second power supply lines perpendicularly connected to a first power supply line in a display area defined by scan lines that branch off one wire, data lines independently connected to the sub pixels, and the first power supply line perpendicularly disposed with respect to the scan lines, thereby preventing voltage drops of power supply lines.

Second, the second power supply lines are used as bypasses to repair the first power supply line, thereby repairing a defective unit pixel.

According to one aspect, a display apparatus includes a plurality of unit pixels each including a plurality of sub pixels, scan lines branching off one wire in a first direction for each of the plurality of unit pixels and that connect the plurality of sub pixels emitting the same color as that of a neighboring unit pixel, data lines extending in a second direction orthogonal to the first direction and connected to the plurality of sub pixels, a first power supply line extending in the first direction and connected to the plurality of sub pixels, and second power supply lines extending in the first direction and connected to the first power supply line.

The second power supply lines may be continuously disposed between the scan lines connected to the plurality of sub pixels of at least the plurality of unit pixels. The second power supply lines may be all connected to the plurality of sub pixels of each of the plurality of unit pixels.

The plurality of sub pixels may emit the same color in the first direction, and emit different colors in the second direction. Lengths of the data lines may be shorter than those of the scan lines.

A length of the first power supply line may be shorter than those of the scan lines. The data lines may be independently connected to the plurality of sub pixels.

Test pads may be further disposed on the scan lines before the scan lines branch off. The first power supply line may be disconnected in a region of at least one of the plurality of unit pixels, in which the scan lines and the first power supply line overlap.

Each of the plurality of sub pixels may comprise a first electrode, a second electrode, and an organic luminescent layer disposed between the first electrode and the second electrode.

The first electrode may be a transparent electrode, and the second electrode may be a reflective electrode. The scan lines, the data lines, the first power supply line, and the second power supply lines may not overlap with the first electrode.

Each of the plurality of sub pixels may comprise at least three thin film transistors (TFTs) and at least two capacitors. The scan driving circuit may further include: compensation control signal lines extending in the second direction and connected to the plurality of sub pixels.

According to another aspect, a method of repairing a display apparatus is disclosed. The display apparatus includes a plurality of unit pixels each including a plurality of sub pixels, scan lines branching off one wire in a first direction for each of the plurality of unit pixels and connecting the plurality of sub pixels emitting the same color as that of a neighboring unit pixel, data lines extending in a second direction orthogonal to the first direction and connected to the plurality of sub pixels, a first power supply line extending in the first direction and connected to the plurality of sub pixels, and second power supply lines extending in the first direction and connected to the first power supply line. The method including: detecting a location of a defective unit pixel that is shorted from the scan lines and the first power supply line by using a voltage difference at both ends of a region in which the scan lines branch off in the first direction and a voltage difference at both ends of the first power supply line, and disconnecting the first power supply line from each sub pixel of the defective unit pixel shorted from the scan lines in the defective unit pixel.

Test pads may be further disposed in the region in which the scan lines branch off, and are used to determine a voltage difference at both ends of the region in which the scan lines branch off.

The second power supply lines may be continuously disposed between the scan lines connected to the plurality of sub pixels of at least the plurality of unit pixels, and supply power to all the sub pixels of the defective unit pixel.

While the present invention has been particularly shown and described with reference to some embodiments thereof, it will be understood by those of ordinary skill in the art that various changes in form and details may be made therein without departing from the spirit and scope of the present invention as defined by the following claims.

What is claimed is:

1. A display apparatus comprising:

a plurality of unit pixels each comprising a plurality of sub pixels;

scan lines branching off a scan wire in a first direction for each of the unit pixels, the scan lines being connected to the sub pixels emitting the same color as that of a neighboring unit pixel;

data lines extending in a second direction orthogonal to the first direction, the data lines being connected to the plurality of sub pixels;

a first power supply line extending in the second direction, the first power supply line being connected to the plurality of sub pixels;

a test pad disposed on the scan wire, the test pad being connected to each of the scan lines; and second power supply lines extending in the first direction, the second power supply lines being connected to the first power supply line and configured to drive the sub pixels when the first power supply line is short-circuited and after disconnecting the first power supply line from each of the sub pixels, wherein the second power supply lines are all connected to the sub pixels of each of the unit pixels.

2. The display apparatus of claim 1, wherein the second power supply lines are disposed between each of the scan lines connected to the plurality of sub pixels of the unit pixels.

3. The display apparatus of claim 1, wherein the sub pixels emit the same color in the first direction, and emit different colors in the second direction.

4. The display apparatus of claim 1, wherein lengths of the data lines are shorter than those of the scan lines.

5. The display apparatus of claim 1, wherein a length of the first power supply line is shorter than those of the scan lines.

6. The display apparatus of claim 1, wherein the data lines are independently connected to the plurality of sub pixels.

7. The display apparatus of claim 1, wherein the first power supply line is disconnected in a region of at least one of the plurality of unit pixels, and wherein the region corresponds to a region in which the scan lines and the first power supply line overlap.

8. The display apparatus of claim 1, wherein each of the plurality of sub pixels comprises a first electrode, a second electrode, and an organic luminescent layer disposed between the first electrode and the second electrode.

9. The display apparatus of claim 8, wherein the first electrode is a transparent electrode, and wherein the second electrode is a reflective electrode.

10. The display apparatus of claim 8, wherein the scan lines, the data lines, the first power supply line, and the second power supply lines do not overlap with the first electrode.

11. The display apparatus of claim 1, wherein each of the plurality of sub pixels comprises at least three thin film transistors (TFTs) and at least two capacitors.

12. The display apparatus of claim 1, further comprising a plurality of compensation control signal lines extending in the second direction and connected to the plurality of sub pixels.

* * * * *